US008037712B2

(12) United States Patent
Cho et al.

(10) Patent No.: US 8,037,712 B2
(45) Date of Patent: Oct. 18, 2011

(54) HERMETIC COMPRESSOR AND REFRIGERATION CYCLE HAVING THE SAME

(75) Inventors: Nam-Kyu Cho, Seoul (KR); Cheol-Hwan Kim, Seoul (KR); Hyo-Keun Park, Seoul (KR); Sung-Yong Ahn, Seoul (KR); Byeong-Chul Lee, Seoul (KR); Se-Heon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/579,629

(22) Filed: Oct. 15, 2009

(65) Prior Publication Data

US 2010/0101270 A1 Apr. 29, 2010

(30) Foreign Application Priority Data

Oct. 28, 2008 (KR) ..... 10-2008-0106128
Oct. 28, 2008 (KR) ..... 10-2008-0106129

(51) Int. Cl.
*F25B 43/02* (2006.01)

(52) U.S. Cl. ..... 62/470; 62/510

(58) Field of Classification Search ..... 62/470, 62/468, 469, 510; 418/55.1, 55.6; 417/13, 417/32, 366
See application file for complete search history.

(56) References Cited

U.S. PATENT DOCUMENTS 4,180,986 A * 1/1980 Shaw ..... 62/192
4,335,582 A * 6/1982 Shaw et al. ..... 62/196.1
4,343,599 A 8/1982 Kousokabe
4,676,075 A * 6/1987 Shiibayashi ..... 62/469
4,829,786 A 5/1989 Sand et al.
5,685,168 A * 11/1997 Sada ..... 62/473
6,017,205 A * 1/2000 Weatherston et al. ..... 418/55.6
6,125,642 A 10/2000 Seener et al.
2007/0214827 A1 9/2007 Venkatasubramaniam
2007/0251264 A1 11/2007 Jang et al.
2008/0209924 A1 9/2008 Yoon et al.

FOREIGN PATENT DOCUMENTS

JP 02-287067 11/1990
JP 07-146018 6/1995
JP 11-303776 11/1999
WO WO 91/06767 5/1991

OTHER PUBLICATIONS

Translation to JP 7-146018 to Naohiro et al.*
European Search Report issued in EP Application No. 09174122.3 dated Feb. 17, 2010.
European Search Report issued in EP Application No. 09174122.3 dated May 7, 2010.

* cited by examiner

*Primary Examiner* — Mohammad Ali
(74) *Attorney, Agent, or Firm* — KED & Associates LLP

(57) ABSTRACT

A hermetic compressor is provided, including a casing, having a suction pipe and discharge pipe connected thereto, a driving motor installed within the casing, a compressing device installed within the casing and operated by the driving motor to form compression chambers, an oil separator that separates oil from a refrigerant discharged from by compressing device, and an oil collecting pipe through which the oil separator communicates with the compression chambers. With this structure, oil can be appropriately supplied to one or more compressors based on capacity, thus improving reliability of oil distribution and enhancing compressor performance.

13 Claims, 10 Drawing Sheets

HERMETIC COMPRESSOR AND REFRIGERATION CYCLE HAVING THE SAME

This application claims priority to Korean Application Nos. 10-2008-0106128 and No. 10-2008-0106129, each filed in Korea on Oct. 28, 2008, the entirety of which are incorporated herein by reference.

BACKGROUND

1. Field

A hermetic compressor and a refrigeration cycle including the same are provided, and in particular, a hermetic compressor having an oil collecting apparatus that collects oil discharged together with a refrigerant, and a refrigeration cycle having a plurality of such hermetic compressors, are provided.

2. Background

A refrigeration cycle essentially includes a compressor, a condenser, an expansion device and an evaporator, which form a closed loop, and which perform a cooling operation by changing a phase of a working fluid (i.e. refrigerant) circulating in the closed loop.

A compressor is a mechanical device that compresses a fluid using mechanical energy. A compressor may include a driving motor that generates a driving force, and a compressing unit that compresses fluid using the driving force generated by the driving motor. Oil may be provided to the compressor to cool the driving motor, to lubricate or seal the compressing unit, and the like.

When a hermetic compressor operates, oil may be discharged together with the compressed fluid, which decreases an amount of oil left inside the compressor for cooling, sealing and lubrication. As a result, reliability of the compressor may be lowered and a heat-exchange function of the refrigeration cycle may be degraded due to oil introduced into the refrigeration cycle. An oil collecting apparatus that separates and collects oil from discharged fluid would improve reliability and performance of this type of compressor.

BRIEF DESCRIPTION OF THE DRAWINGS

The embodiments will be described in detail with reference to the following drawings in which like reference numerals refer to like elements wherein.

DETAILED DESCRIPTION

An oil collecting apparatus that separates oil from compressed fluid and collects the separated oil into an inner space of the compressor has recently been developed. Recently, as variable compression capacity has become desirable and the size of refrigeration loads during a compression operation has increased, refrigeration cycles having a plurality of compressors are being used so that cooling performance may be adjusted and compression capacity may be varied by operating all or some of the plurality of compressors.

Appropriately distributing separated and collected oil to each compressor to compensate for a difference in oil levels among the plurality of compressors caused by a difference in an amount of oil discharged between operating and non-operating compressors and between operating compressors is required. A distribution approach, in which an outlet of an oil collecting apparatus provided with each compressor is connected to a common suction line, which is in turn connected to a suction pipe of each compressor may be considered. This collects all the oil/refrigerant in a central area. However, the oil is at a relatively high temperature compared to the refrigerant, which increases a specific volume of the refrigerant, resulting in a degradation of compression efficiency.

Figure 1:
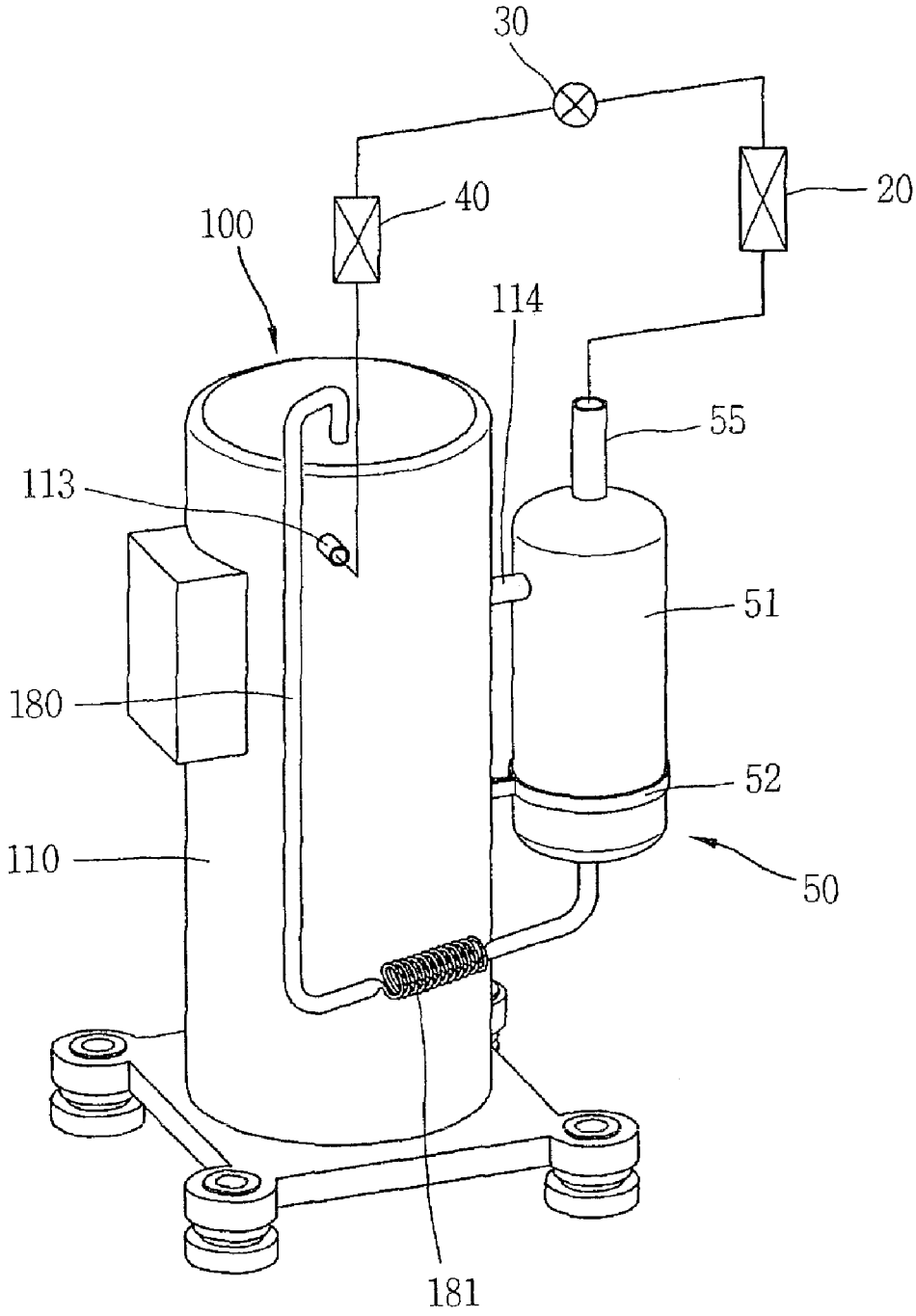
FIG. 1 illustrates a refrigeration cycle including a hermetic compressor in accordance with an embodiment as broadly described herein.
Figure 2:
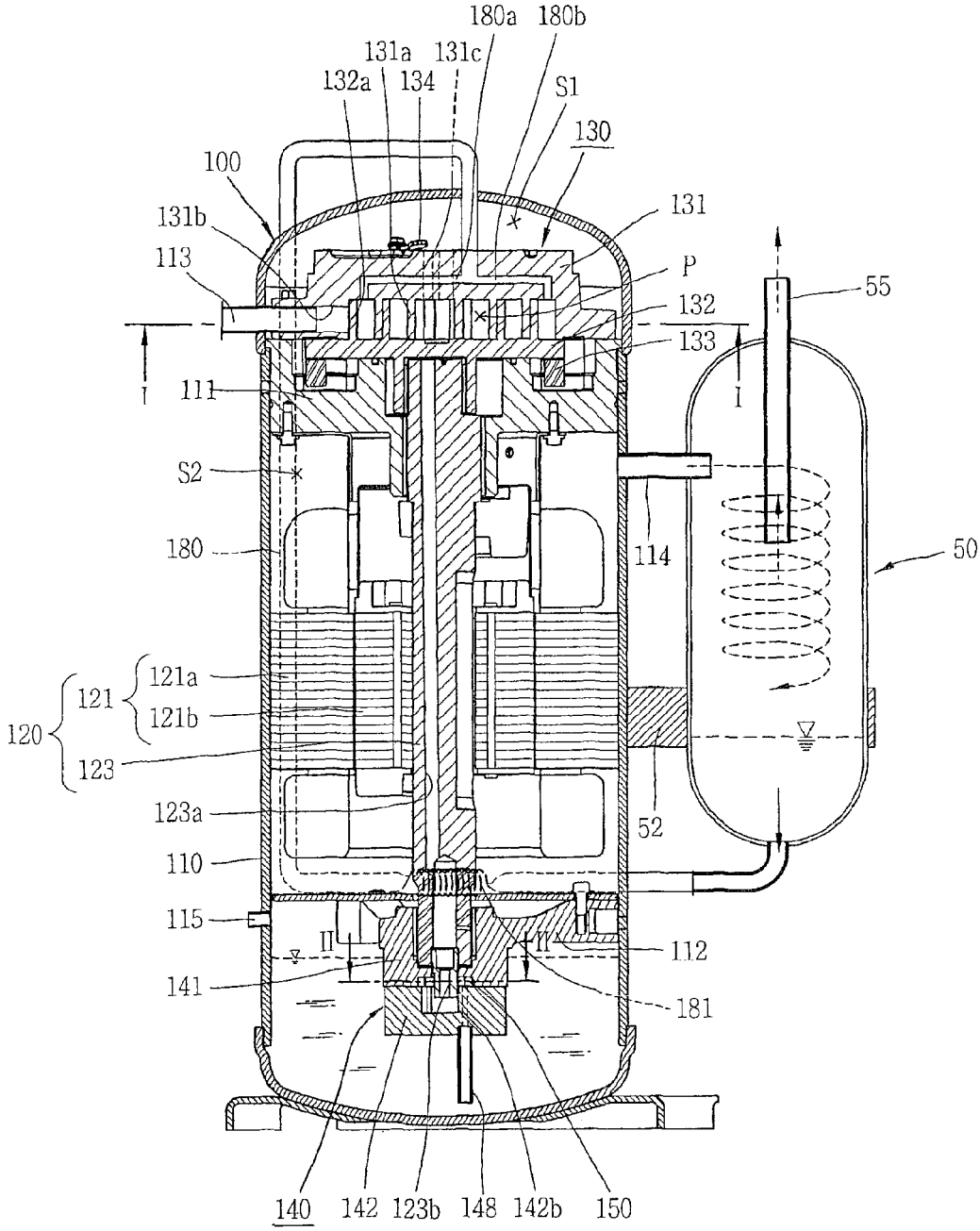
FIG. 2 is a longitudinal cross-sectional view of the hermetic compressor and an oil collecting apparatus shown in FIG. 1.
Figure 3:
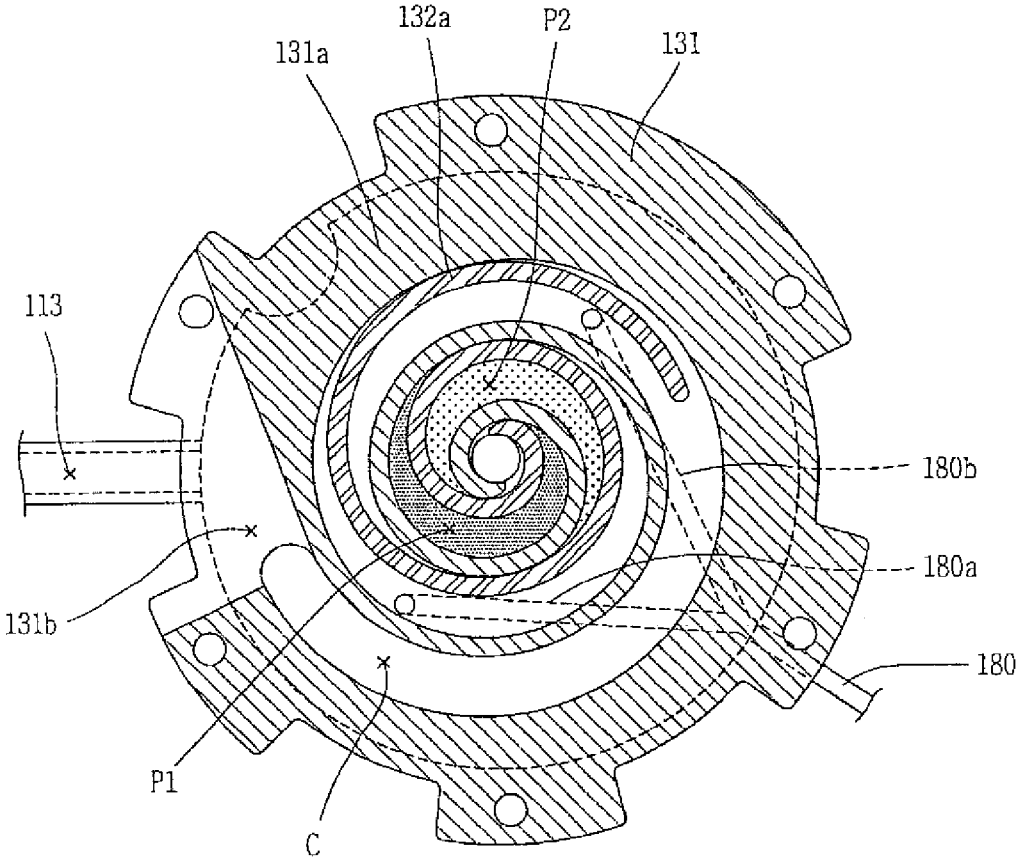
FIG. 3 is a view taken along the line I-I of FIG. 2.

The hermetic compressor 100 shown in FIGS. 1-3 is included in a refrigeration cycle together with a condenser 20, an expansion device 30, and an evaporator 40. A suction pipe 113 coupled to a casing 110 may be connected to the evaporator 40, and a discharge pipe 114 may be connected to the condenser 20. The hermetic compressor 100 may also include a driving device 120, a compressing device 130, an oil separator 50 installed between a discharge side of the hermetic compressor 100 and an inlet side of the condenser 20, for separating oil mixed with a refrigerant discharged via the discharge pipe 114, and an oil collecting pipe 180 that supplies oil separated in the oil separator 50 to the compressing device 130.

The casing 110 may form a hermetic inner space. The suction pipe 113 introduces a low pressure gaseous refrigerant, that has passed through the evaporator 40, into the compressor 100, and the discharge pipe 114 receives a compressed high pressure gaseous refrigerant for discharge from the compressor 100. The inner space of the casing 110 may be provided with a main frame 111 supporting one end of the driving device 120 and the compressing device 130 driven by the driving device 120 to compress a refrigerant, and a sub frame 112 supporting another end of the driving device 120. An oil supply hole 115 through which oil is injected into the inner space of the casing 110 may be formed at a lower portion of the casing 110. When a plurality of compressors are employed in a refrigerating cycle, the oil supply hole 115 may be used as an oil equalizing hole for communicating with the plurality of compressors so as to equalize an oil level of each compressor.

The driving device 120 may include a driving motor 121 installed in the inner space of the casing 110 for generating a driving force, and a rotational shaft 123 coupled to the driving motor 121. The driving motor 121 may include a stator 121*a* fixed to an inner circumferential surface of the casing 110, and a rotor 121*b* rotatably disposed inside the stator 121*a*. The rotational shaft 123 may be coupled to the center of the rotor 122*b*, and may be supported by the main and sub frames 111 and 112 so as to transfer a rotational force of the rotor 121*b* to the compressing device 130. An oil passage 123*a* may penetrate through the rotational shaft 123 in the longitudinal shaft direction so as to allow oil supplied to the compressing device 130 to flow up therethrough.

The compressing device 130 may include a fixed scroll 131 and a orbiting scroll 132 that both operate in cooperation with the rotational shaft 123. The fixed scroll 131 may be coupled to the main frame 111, and may include an outlet 131*c* through which a compressed refrigerant is discharged, and a check valve 134 that blocks a backflow of gas discharged via the outlet 131*c*. The orbiting scroll 132 may be supported by the main frame 111, engaged with the fixed scroll 131, and may orbit in cooperation with the rotational shaft 123.

An Oldham ring 133 that provides for the orbiting motion of the orbiting scroll 132 may be disposed between the orbiting scroll 132 and the main frame 111.

The fixed scroll 131 and the orbiting scroll 132 may include a fixed wrap 131*a* and an orbiting wrap 132*a*, respectively, which are radially formed and engaged with each other to consecutively fond a pair of compression chambers P. The compression chambers P may be formed by the fixed wrap 131*a* of the fixed scroll 131 and the orbiting wrap 132*a* of the orbiting scroll 132, which orbits with respect to the fixed scroll 131. Internal volumes of the pair of compression chambers P may be varied by the rotation of the orbiting scroll 132, so as to compress a refrigerant held therein. The compression chambers P may move toward the central portion of the fixed scroll 131 in cooperation with the rotation of the orbiting scroll 132. A compressed refrigerant may be discharged via the outlet 131*c* of the fixed scroll 131.

The suction pipe 113 may be directly connected to an inlet 131*b* of the fixed scroll 131, and the outlet 131*c* of the fixed scroll 131 may communicate with the inner space of the casing 110. Accordingly, refrigerant contained within the inner space of the casing 110 may have substantially the same pressure as a discharge pressure, as in a 'high pressure type hermetic compressor'.

In contrast, in order for a refrigerant contained within the inner space of the casing 110 to have substantially the same pressure as a suction pressure, a suction side of the compressing device 130 may communicate with the inner space of the casing 110 and the discharge pipe 114 may be directly connected to the discharge side of the compressing device 130, as in a 'low pressure type hermetic compressor'.

A high pressure type hermetic compressor is shown in FIG. 2, merely for ease of discussion. However, the principles set forth herein may also be applicable to the low pressure type hermetic compressor.

The oil separator 50 is a device that separates oil from refrigerant that has been discharged from the casing 110. The oil separator 50 may be connected to the discharge pipe 114 of the compressor 100. An oil-separated refrigerant may be supplied to the condenser 20 via an exhaust pipe 55, and the separated oil flows toward the compressing device 130 via the oil collecting pipe 180. The oil separator 50 may be cylindrically formed with a hermetic inner space, and may be disposed in parallel at one side of the casing 110. The oil separator 50 may be connected to the oil collecting pipe 180 and supported at the casing 110 or by a separate supporting member 52, such as a clamp.

Various methods for separating oil and refrigerant may be applied. For example, a method using a mesh screen installed in the inner space of the oil separator 50 may be used to allow separation between refrigerant and oil, or a method in which the discharge pipe 114 may be off-set with respect to an axial center of the oil separator 50 so as to generate a cyclonic flow and cause relatively heavy oil to be separated from the refrigerant. Other methods may also be appropriate.

A first end of the oil collecting pipe 180 may be coupled to the lower portion of the oil separator 50 in which the separated oil is stored, and a second end may be coupled to the compressing device 130, so as to allow the separated oil to be supplied to the compression chambers P of the compressing device 130. In this embodiment, the oil collecting pipe 180 may also include a decompressing device 181 such as, for example, a capillary tube. Accordingly, oil or refrigerant from the compression chambers P may be prevented from flowing back into the inner space of the oil separator 50.

The oil collecting pipe 180 may penetrate through the fixed scroll 131 so as to provide for communication between the compression chambers P and the outlet of the oil separator 50. In this embodiment, the compression chambers P are formed as a pair (i.e., P1 and P2) at positions symmetrical to each other with respect to the center of the fixed scroll 131. Internal pressures of the pair of compression chambers P1 and P2 are substantially the same. The oil collecting pipe 180 may communicate simultaneously with the pair of compression chambers P1 and P2.

As aforementioned, the compression chambers P move toward the central portion of the fixed scroll 131 in cooperation with the orbiting motion of the orbiting scroll 132, thus to compress a refrigerant held therein. The internal pressures of the pair of compression chambers P may be equalized by making the compression chambers P1 and P2 move the same distance in cooperation with the orbiting motion of the orbiting scroll 132.

In this embodiment, the oil collecting pipe 180 communicates with the pair of compression chambers P1 and P2 at the beginning of the compression operation. That is, the oil collecting pipe 180 may be configured such that oil is supplied to the compression chambers P1 and P2 just after the compression chambers P1 and P2 are created by the fixed wrap 131*a* and the orbiting wrap 132*a*. Accordingly, oil may be smoothly and consistently supplied to the compression chambers P1 and P2 in a relatively low pressure state. Also, since at this point in operation the volumes of the compression chambers P1 and P2 have been established, a problem of an increase in a specific volume of refrigerant due to oil mixed therein can be prevented.

In this embodiment, an end of the oil collecting pipe 180 may be respectively connected to the pair of compression chambers P1 and P2, and oil may simultaneously be supplied into each of the compression chambers P1 and P2 via the oil collecting pipe 180.

To this end, the oil collecting pipe 180 may diverge at a certain point to reach each of the compression chambers P1 and P2. In certain embodiments, a pair of oil supply channels 180*a* and 180*b* may be formed in the fixed scroll 131 to provide for communication between the compression chambers P1 and P2 and the oil collecting pipe 180.

In order for substantially the same amount of oil to be supplied via the oil supply channels 180*a* and 180*b*, the pair of oil supply channels 180*a* and 180*b* may have the same length.

In this embodiment, the ends of the oil supply channels 180*a* and 180*b*, or the end of the oil collecting pipe 180, that communicate with the compression chambers P1 and P2, communicate with a compression space C formed by the fixed wrap 131*a* of the fixed scroll 131. This may lie at the center of a circular trace along which a certain point of the orbiting wrap 132 moves in cooperation with the orbiting motion of the orbiting scroll 132, as shown in FIG. 3. Accordingly, as the orbiting scroll 132 orbits, oil supplied through the ends of the oil supply channels 180*a* and 180*b*, or the end of the oil collecting pipe 180, may be alternately supplied to the pair of compression chambers P1 and P2.

Figure 4:
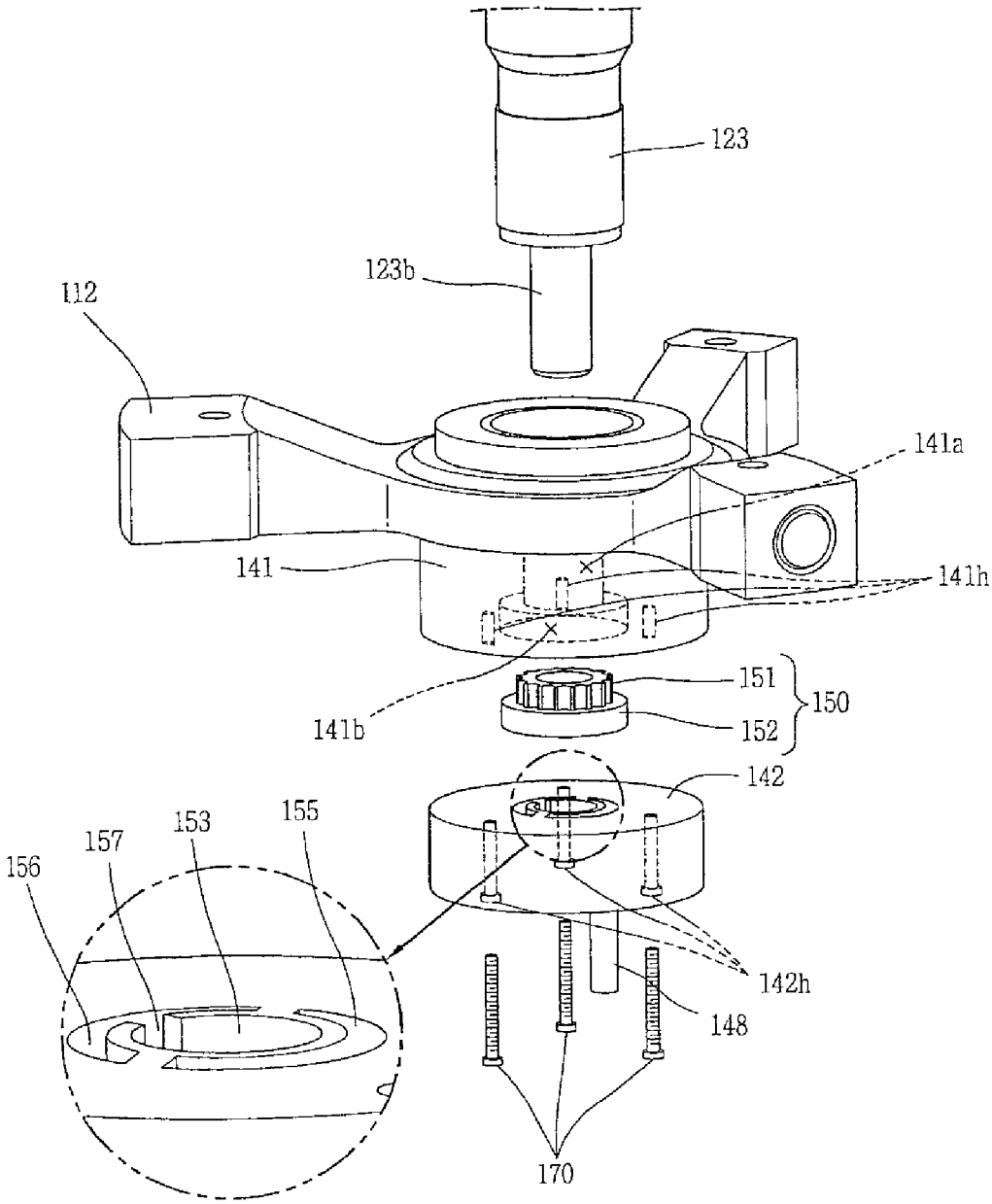
FIG. 4 is a disassembled view of an oil supply device shown in FIG. 2.
Figure 5:
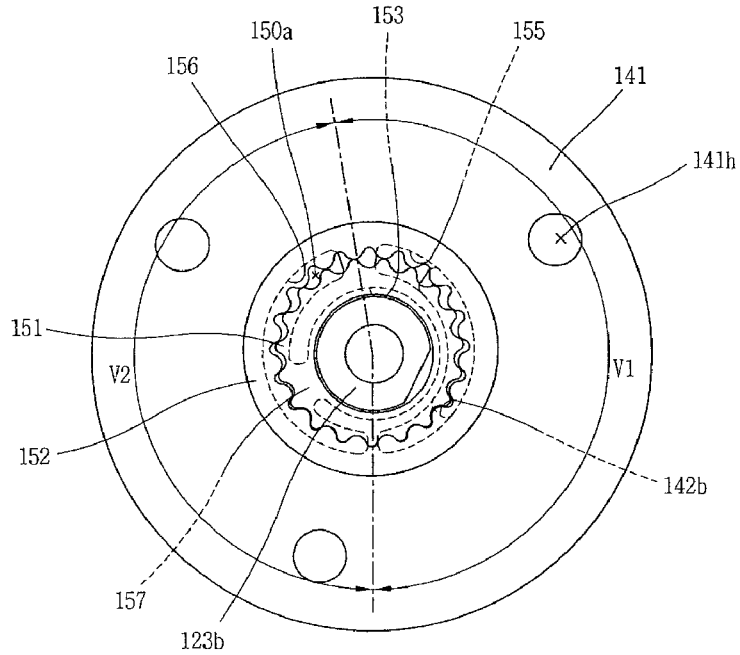
FIG. 5 is a view taken along the line II-II of FIG. 2.
Figure 6:
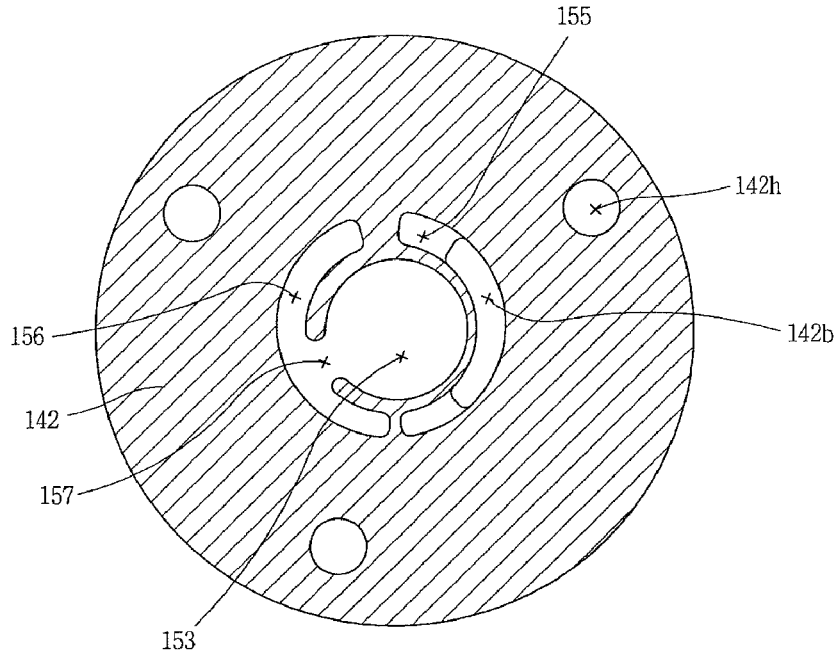
FIG. 6 is a view of an upper surface of a pump cover shown in FIG. 2.

A hermetic compressor 100 in accordance with this embodiment may also include an oil supply device 140 that supplies oil stored in the casing 110 to the compressing device 130 and the driving device 120, as shown in FIGS. 4-6.

The oil supply device 140 may include an oil pump 150 coupled to the rotational shaft 123, including a capacity variable portion 150*a* to perform a pumping operation, a pump housing 141 installed inside the casing 110 to accommodate the oil pump 150, and a pump cover 142 coupled to the pump housing 141 to supply oil to the oil pump 150. The pump housing 141 may include a pump accommodating portion 141*b* that receives the oil pump 150, and a pin receiving portion 141*a* having a pin 123*b*, extending from the rotational shaft 123, inserted therethrough.

The pump housing 141 may be coupled to a lower portion of the sub frame 112, or integrally may be formed with the sub frame 112.

The oil pump 150 may be configured as a volumetric pump such as, for example, a trochoid gear pump, which pumps oil with varying capacity, or other pump type as appropriate.

In certain embodiments, the oil pump 150 includes an inner gear 151 rotatably accommodated in the pump accommodating portion 141*b* and coupled to the rotational shaft 123 to eccentrically rotate, and an outer gear 152 rotatably disposed at the pump accommodating portion 141*b* so as to form the capacity variable portion 150*a* through engagement with the inner gear 151.

The oil pump 150 may be operated by the rotational shaft 123 to pump oil contained in the inner space of the casing 110 or oil separated from refrigerant that has been discharged out of the compressing device 130. The pumped oil flows upwardly along the oil passage 123*a*, so as to lubricate the compressing device 130 and simultaneously cool the driving motor 121.

The pump cover 142 may include an oil suction hole 142*b* through which oil may be drawn up from the bottom of the casing 110. The oil suction hole 142*b* may be formed in a shaft direction so as to communicate with an oil suction pipe 148 through which oil contained in the casing 110 is drawn up. Hence, an inlet of the oil suction pipe 148 may be formed long enough to be submerged the oil contained in the casing 110.

The pump cover 142 may also include a communicating groove 153 formed in a central portion of an upper surface of the pump cover 142 such that the oil passage 123*a* of the rotational shaft 123 may extend therethrough. A suction guide groove 155 may be formed around one side of the communicating groove 153 so as to communicate with the oil suction hole 142*b*. A discharge guide groove 156 may be formed at a position spaced apart from the suction guide groove 155 in a circumferential direction to discharge oil pumped by the oil pump 150. The suction and discharge guide grooves 155 and 156 may have an arcuate shape, or other shape as appropriate. A discharge slot 157 may be formed at an inner wall of the discharge guide groove 156, in communication with the communicating groove 153.

The capacity variable portion 150*a* may be configured by a suction capacity part V1 and a discharge capacity part V2. A capacity of the suction capacity part V1 may be gradually increased from a start point to an end point in the circumferential direction of the suction guide groove 155, along a rotating direction of the inner gear 151, and the discharge capacity part V2 may be connected to the suction capacity part V1, and its capacity may be decreased from a start point of the discharge guide groove 156 to an end point thereof, along the rotating direction of the inner gear 151.

Description will now be provided of a process in which oil within the casing 110 and refrigerant-separated oil are collected using the oil pump 150 for supply back to the compressing device 130.

The inner gear 151 of the oil pump 150 is coupled to the rotational shaft 123, causing the inner gear 151 to eccentrically rotate, and accordingly the suction capacity part V1 and the discharge capacity part V2 are formed between the inner gear 151 and the outer gear 152.

The suction capacity part V1 is in communication with the oil suction hole 142*b*. The oil contained in the bottom of the casing 110 is introduced in the suction guide groove 155 via the oil suction pipe 148 and the oil suction hole 142*b*. Accordingly, the oil introduced into the suction guide groove 155 flows from the suction capacity part V1 to the discharge capacity part V2.

The oil in the discharge capacity part V2 is then introduced into the discharge guide groove 156, and then into the communicating groove 153 via the discharge slot 157 formed at the inner circumferential wall surface of the discharge guide groove 156. The oil is then drawn from the communicating groove 153 into the oil passage 123*a* of the rotational shaft 123.

The oil drawn into the oil passage 123*a* is pushed up through the oil passage 123*a* by a centrifugal force of the rotational shaft 123. During this process, part of the oil is supplied to each bearing surface, and the remainder of the oil is scattered at the upper end of the oil passage 123*a*, where it is introduced in the compressing device 130. These steps may be repeatedly performed.

In a hermetic compressor as embodied and broadly described herein, oil is introduced during a compression process which is performed after a refrigerant is drawn into a compressing device of the hermetic compressor, which may prevent loss of compression efficiency due to an increase in a specific volume of a refrigerant with oil supplied to a suction side of the hermetic compressor.

A method of collecting oil that has been separated in an oil separator and supplying it to compression chambers, other than supplying such oil to a suction side of a hermetic compressor, may also be applied. However, in the hermetic compressor as embodied and broadly described herein, the oil separated in the oil separator is directly introduced into the compression chambers of the compressing device via the oil collecting pipe. Hence, a simple configuration may be implemented compared to the above method, whereby reliability may be enhanced and fabricating cost may be reduced.

Also, since the oil separated in the oil separator is directly introduced into the compression chambers of the compressing device via the oil collecting pipe, lubrication of compressing device and reliability of cooling operation may be improved, resulting in improved compressor performance.

Hereinafter, another embodiment of a hermetic compressor as broadly described herein will be discussed in more detail with reference to FIG. 7.

For ease of discussion, the same or similar elements which may be understood by the description above will not be described in detail again.

Figure 7:
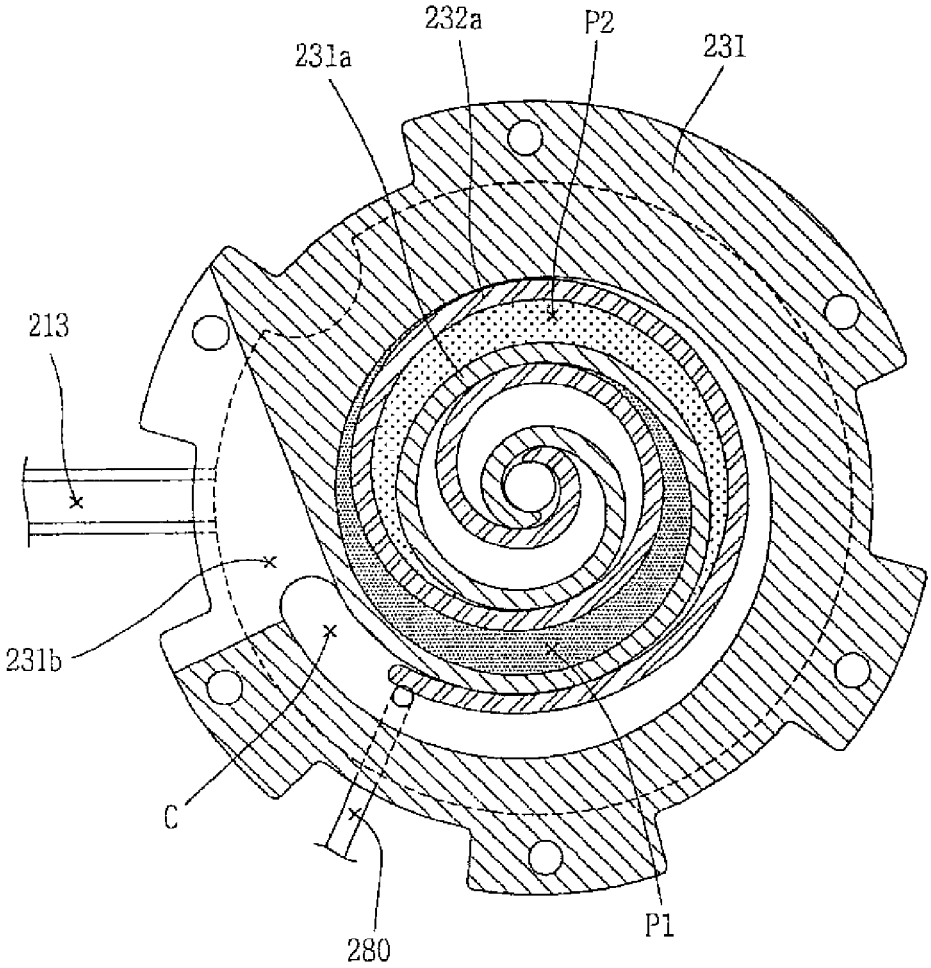
FIG. 7 is a cross-sectional view of compression chambers of a hermetic compressor in accordance with another embodiment as broadly described herein.

FIG. 7 is a cross-sectional view of compression chambers of a hermetic compressor in accordance with another embodiment as broadly described herein.

The embodiment of the hermetic compressor 200 shown in FIG. 7 may have a similar configuration to the hermetic compressor 100 shown in FIGS. 1-6. However, the structure of the compression chambers P and the structure of an oil collecting pipe 280 that supplies oil to the compression chambers P is different.

In the hermetic compressor 200 shown in FIG. 7, the compression chambers P may be formed as a pair P1 and P2, at positions symmetrical to each other with respect to the center of a fixed scroll 231, and the compression chambers P1 and P2 may have different internal pressures. This type of hermetic compressor may be referred to as an 'asymmetrical hermetic compressor' in contrast with the aforesaid 'symmetrical hermetic compressor'. In this type of compressor, a refrigerant may start to be compressed at a position close to a suction portion 231*b* of a compression space formed by a fixed wrap 231*a* of the fixed scroll 231, which is advantageous in enhancing compression performance. In this embodiment, an end of the oil collecting pipe 280 may be formed at a position which alternately communicates with the pair of compression chambers P1 and P2. Thus, the end of the oil collecting pipe 280 may be disposed at the center of a circular trace along which a certain point of an orbiting wrap 232*a* moves in cooperation with the orbiting motion of an orbiting scroll 232.

Another embodiment of a hermetic compressor as broadly described herein will be discussed in more detail with reference to FIG. 8.

For ease of discussion, the same or similar elements will not be described in detail again.

Figure 8:
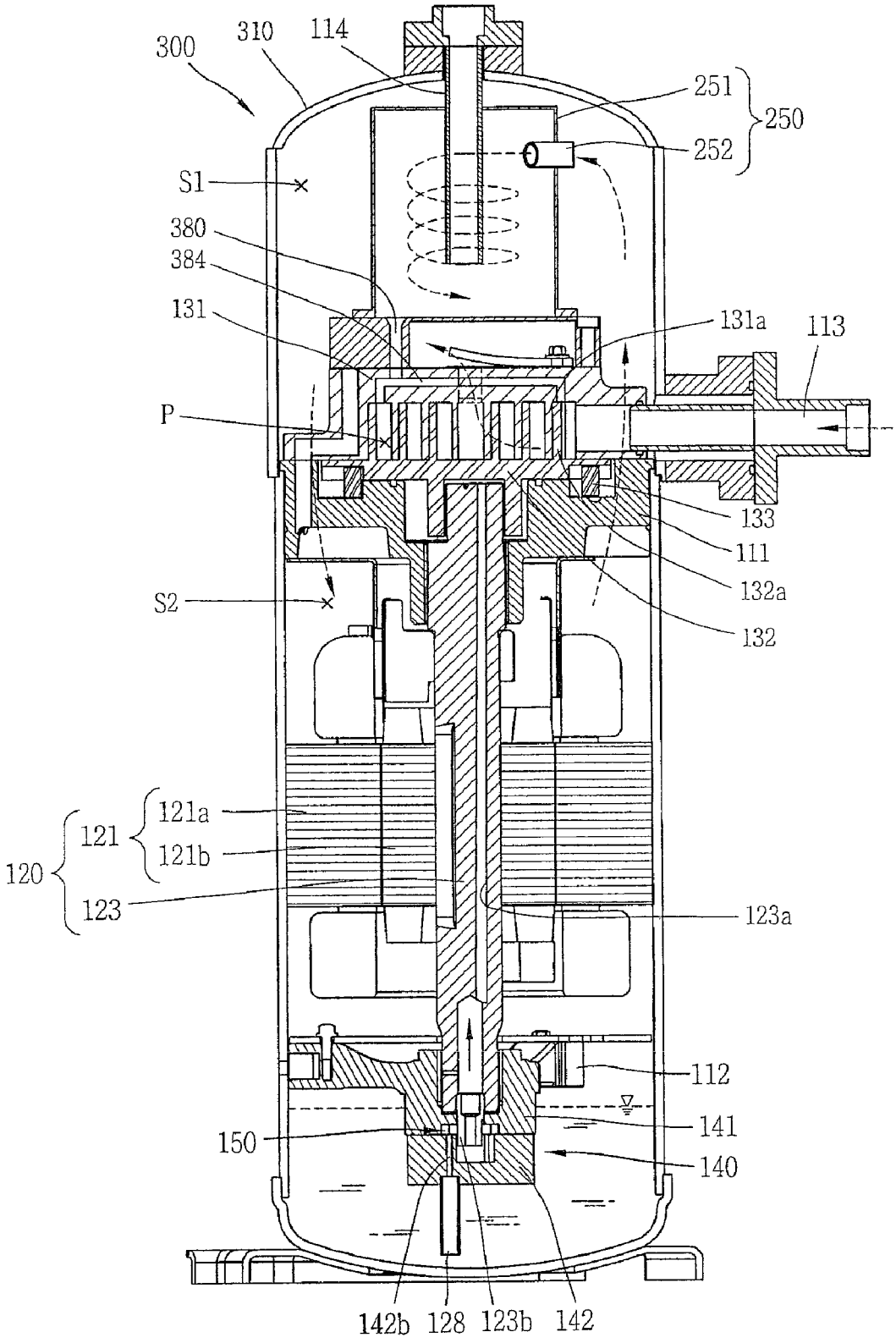
FIG. 8 is a longitudinal cross-sectional view of a hermetic compressor and an oil collecting apparatus in accordance with another embodiment as broadly described herein.

FIG. 8 is a longitudinal cross-sectional view of a hermetic compressor and an oil collecting apparatus in accordance with another embodiment as broadly described herein.

The hermetic compressor 300 shown in FIG. 8 may include an oil separator 250 installed within a casing 310 of the hermetic compressor 300.

Refrigerant compressed in the compressing device 130 may be discharged into the casing 310. While the refrigerant circulates inside the casing 310, oil may be partially separated from the refrigerant and flow down to a lower portion of the casing 310. The remaining non-separated oil and the compressed refrigerant may be introduced into the oil separator 250 via an inlet 252 of the oil separator 250.

Afterwards, oil separated in the oil separator 250 may be collected at the bottom of a case 251 of the oil separator 250, and then supplied to the compression chambers P via an oil collecting pipe 380 that extends between the lower portion of the case 251 and the compression chambers P.

A refrigeration cycle in accordance with another embodiment, as broadly described herein will be discussed in more detail with reference to FIGS. 9 and 10.

Figure 9:
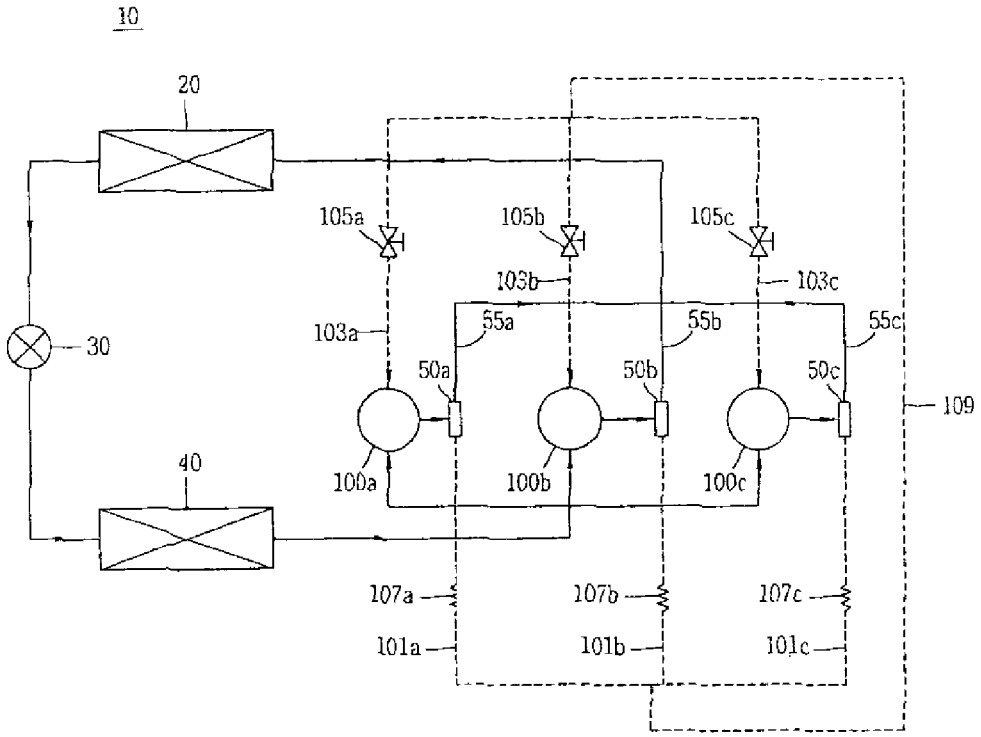
FIG. 9 is a schematic view of a refrigeration cycle in accordance with another embodiment as broadly described herein.
Figure 10:
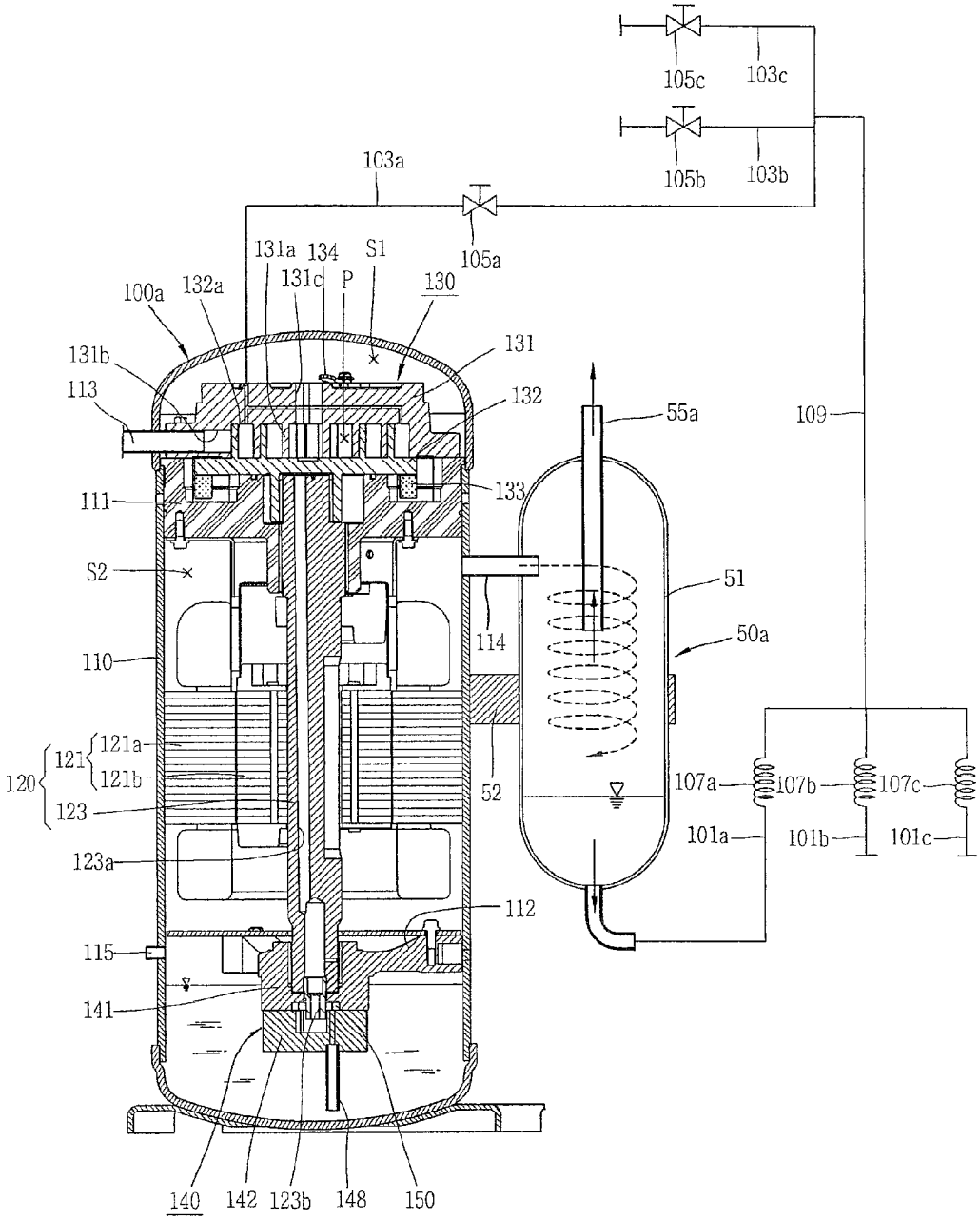
FIG. 10 illustrates a pipe connected state with the inside of a compressor shown in FIG. 9.

FIG. 9 is a schematic view of a refrigeration cycle in accordance with another embodiment as broadly described herein, and FIG. 10 illustrates a pipe connected state with the inside of one of the compressors shown in FIG. 9.

As shown in FIG. 9, a refrigeration cycle 10 may include a condenser 20 that condenses a refrigerant therein into a liquid refrigerant at intermediate temperature and high pressure, an expansion device 30 that decompresses the refrigerant discharged from the condenser 20 to a liquid refrigerant at low temperature and low pressure, and an evaporator 40 that evaporates the refrigerant discharged from the expansion device 30 as a gaseous refrigerant at high temperature and low pressure using heat adsorbed from the exterior. The refrigeration cycle 10 may include a plurality of compressors 100*a*, 100*b* and 100*c* for compressing the refrigerant discharged from the evaporator 40 into a gaseous refrigerant at high temperature and high pressure.

The plurality of compressors 100*a*, 100*b* and 100*c* may each include oil separators 50*a*, 50*b* and 50*c*, respectively, for separating oil from a refrigerant discharged therefrom.

The oil separators 50*a*, 50*b* and 50*c* may be respectively connected to refrigerant pipes 55*a*, 55*b* and 55*c* through which the refrigerant is discharged, and may also be respectively connected to oil converging pipes 101*a*, 101*b* and 101*c* through which separated oil is collected.

The refrigerant pipes 55*a*, 55*b* and 55*c* may be connected to the condenser 20, and the oil converging pipes 101*a*, 101*b* and 101*c* may converge into one to be connected to the connection pipe 109. The connection pipe 109 may then connected to oil supply pipes 103*a*, 103*b* and 103*c* through which oil collected via the oil converging pipes 101*a*, 101*b* and 101*c* is supplied into each of the compressors 100*a*, 100*b* and 100*c*.

The oil supply pipes 103*a*, 103*b* and 103*c* may be provided with control valves 105*a*, 105*b* and 105*c*, respectively, for controlling oil supply based on an operation state of the compressors 100*a*, 100*b* and 100*c* respectively connected thereto.

The control valves 105*a*, 105*b* and 105*c* may be configured as a valve such as, for example, a solenoid, which may control oil introduction into non-operating compressors and prevent oil discharge therefrom. Other types of valves may also be appropriate.

In this embodiment, three compressors 100 shown for the sake of explanation. However, the extension to N compressors based upon the aforesaid pipe structure may be understood by those skilled in the art.

An operation of the refrigeration cycle 10 so configured will now be described.

First, for a relatively large refrigeration load, the plurality of compressors 100*a*, 100*b* and 100*c* are all operated. Oil discharged from each of the compressors 100*a*, 100*b* and 100*c* flows sequentially via the oil converging pipes 101*a*, 101*b* and 101*c*, the connection pipe 109 and the oil supply pipes 103*a*, 103*b* and 103*c*, and is supplied back into each of the compressors 100*a*, 100*b* and 100*c*. The control valves 105*a*, 105*b* and 105*c* disposed at the oil supply pipes 103*a*, 103*b* and 103*c* are all open at this point. An amount of oil supplied to each of the compressors 100*a*, 100*b* and 100*c* is supplied in proportion to their rotation velocities. Hence, more oil is supplied to a compressor in which a large amount of refrigerant is drawn, which facilitates an appropriate oil distribution among the compressors.

On the other hand, for a relatively small refrigeration load, only some of the compressors 100*a*, 100*b* and 100*c* are operated, and the remainder are not operated. In this case, the appropriate control valve(s) connected to the non-operating compressor(s) is/are closed. Accordingly, the oil introduction into the non-operating compressors and the oil discharge therefrom may be prevented.

In this embodiment, decompressing units 107*a*, 107*b* and 107*c* may be provided respectively at the oil converging pipes 101*a*, 101*b* and 101*c* so as to lower pressure and prevent the backflow of oil discharged from the oil separators 50*a*, 50*b* and 50*c*.

Also, in this embodiment, the oil supply pipes 103*a*, 103*b* and 103*c* may communicate with the compression chambers P formed within the plurality of compressors 100*a*, 100*b* and 100*c*.

Now, one compressor and a pipe structure for supplying oil to the compressor will be described in detail with reference to FIG. 10.

As shown in FIG. 10, the compressor 100*a* may include a compressor casing 110, a driving motor 121, a compressing device 130, an oil separator 50*a* disposed at a pipe connecting a discharge side of the compressor 100*a* to an inlet of the condenser 20 for separating oil from refrigerant discharged via the discharge pipe 114, and an oil converging pipe 101*a*, a connection pipe 109 and an oil supply pipe 103*a* all for supplying oil separated in the oil separator 50*a* to the compressing device 130.

The configuration of this embodiment of the compressor 100*a* is the same or similar to that of the aforesaid embodiment, and thus a detailed description thereof will be omitted.

In this embodiment, the oil separator 50*a* is a device that separates oil from a refrigerant discharged out of the casing 110. The oil separator 50*a* is connected to the discharge pipe 114 of the compressor 100*a*. The oil-separated refrigerant is supplied into the condenser 20 via the refrigerant pipe 55*a*, and the separated oil is supplied into the compression chambers P of the compressing device 130 sequentially via the oil converging pipe 101*a*, the connection pipe 109 and the oil supply pipe 103*a*.

One end of the oil converging pipe 101*a* is connected to the lower portion of the oil separator 50*a* in which the separated oil is stored, and another end is converged with the oil converging pipes 101*b* and 101*c* for collecting the separated oil from the other compressors 100*b* and 100*c*.

One end of the connection pipe 109 is connected to the oil converging pipes 101*a*, 101*b*, 101*c*, and the other end of the connection pipe 109 is connected to the oil supply pipe 103*a* connected to each of the compression chambers P.

The control valve 105*a* is disposed at the oil supply pipe 103*a* so as to control whether flows of oil through oil supply pipe 103*a*. The control valve 105*a* is open upon the operation of the compressor 100*a*, while being closed upon the non-operation thereof. In this embodiment, the decompressing unit 107*a*, such as, for example, a capillary tube may be provided at the oil converging pipe 101*a*. Accordingly, refrigerant discharged out of the oil separator 50*a* may be prevented from flowing backward.

In this embodiment, the compression chambers P may be implemented in various structures as described above, and the oil supply pipe 103*a* may simultaneously communicate with the pair of compression chambers P.

In the refrigeration cycle according to this embodiment, oil separated in each of the oil separators provided at a plurality of compressors is collected into oil converging pipes and then directly supplied to each compressor. Hence, more oil may be supplied into a compressor with a larger refrigerant flow, so as to improve reliability among the plurality of compressors.

Also, oil may be directly supplied to the compression chambers of each compressor via oil supply pipes so as to supply oil to suction lines of a plurality of compressors, thereby preventing degradation of compression performance.

Hereinafter, still another embodiment of a refrigeration cycle as broadly described herein will be discussed in more detail with reference to FIG. 11.

For ease of discussion, the same or similar elements will not be described in detail again.

Figure 11:
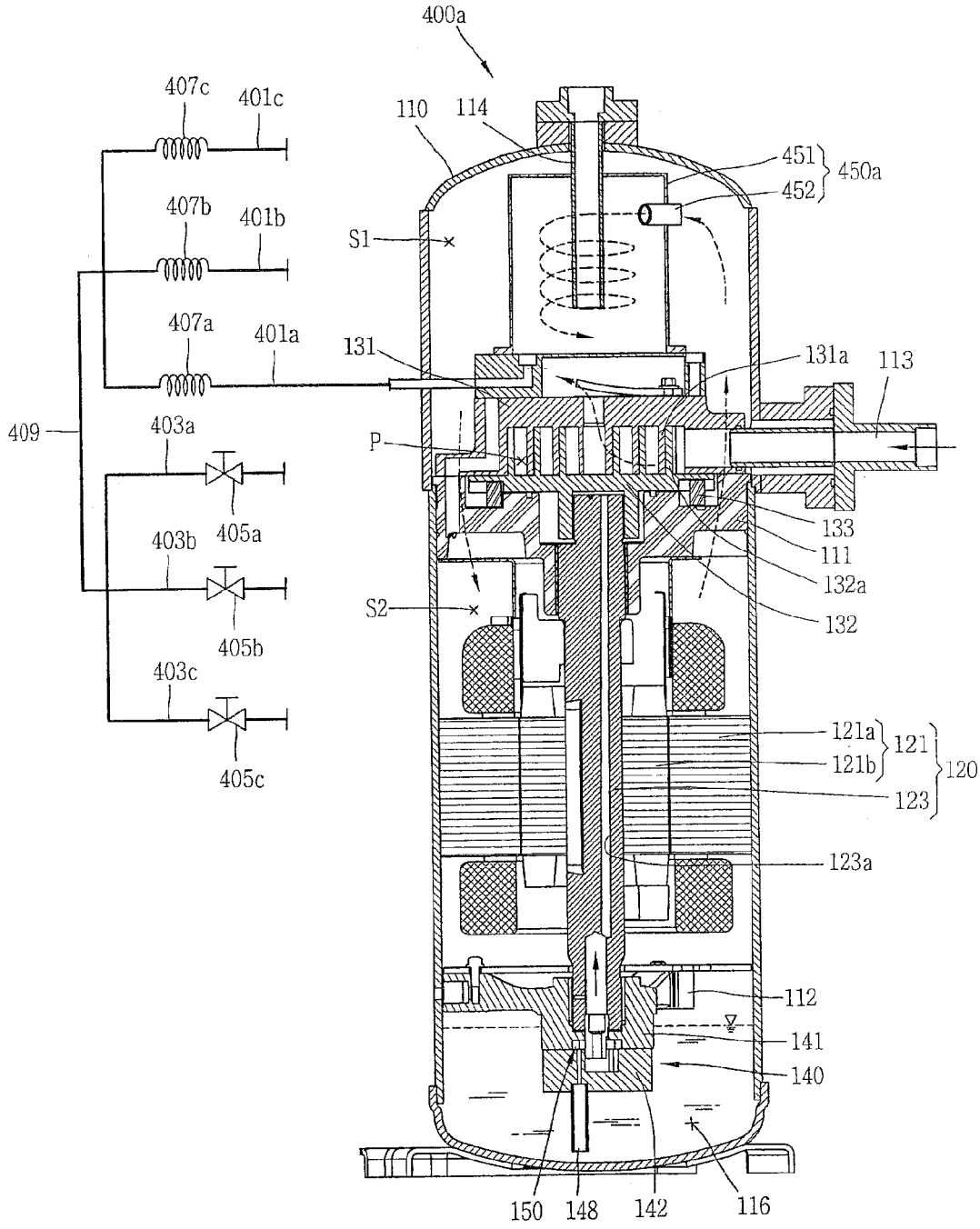
FIG. 11 illustrates a pipe connected state with the inside of a compressor in a refrigerating cycle in accordance with another embodiment as broadly described herein.

FIG. 11 illustrates a pipe connected state with the inside of one compressor in a refrigerating cycle in accordance with another embodiment as broadly described herein. As shown in FIG. 11, a compressor 400*a* may include an oil separator 450*a* installed within the casing 110 of the compressor 400*a*.

That is, this embodiment has substantially the same or similar configuration to the embodiment described above, excluding that oil separators 250*a*, 250*b* and 250*c* are installed within a plurality of compressors 400*a*, 400*b* and 400*c*, respectively.

Accordingly, a refrigerant compressed in the compressing device 130 is discharged into the casing 110 so as to circulate inside the casing 110. During the circulation, part of the oil is separated from the refrigerant and flows down to a lower portion of the casing 110. The remaining non-separated oil and the compressed refrigerant are introduced into the oil separator 450*a* via an inlet 452 of the oil separator 450*a* located within the casing 110.

Afterwards, oil separated in the oil separator 450*a* is collected in the bottom of the case 451 of the oil separator 450*a*. The lower portion of the case 451 is connected to the oil converging pipe 401*a* for collecting oil, and the oil converging pipe 401*a* is connected to oil supply pipes 403*a*, 403*b* and 403*c* via the connection pipe 409. Accordingly, such collected oil in the lower portion of the case 451 flows via the oil converging pipe 401*a* and is supplied to the compression chambers P through the oil supply pipes 403*a*, 403*b* and 403*c* via the connection pipe 409.

Accordingly, an appropriate distribution of oil among the compressors may be facilitated and a capacity occupied by the oil separator may be reduced.

A hermetic compressor is provided that is capable of improving a performance of a compressor as well as minimizing an increase in a fabricating cost due to a simple configuration of an oil collecting apparatus.

A refrigeration cycle having the hermetic compressor in plurality is provided, which employs an oil distributing method among the plurality of compressors, capable of minimizing an increase in a fabricating cost and preventing a degradation of compression efficiency of the compressors.

A hermetic compressor as embodied and broadly described herein may include a casing having a hermetic inner space and having suction pipe and discharge pipe connected thereto; a driving motor installed within the inner space of the casing and configured to generate a driving force; a compressing unit installed within the inner space of the casing and operated by the driving motor to form compression chambers for compressing a refrigerant; an oil separator configured to separate oil from a refrigerant discharged from the compressing unit; and an oil collecting pipe through which the oil separator is communicated with the compression chambers such that oil separated in the oil separator is supplied into the compression chambers.

The compression chambers may be formed by a fixed wrap of a fixed scroll fixed to the inner space of the casing and an orbiting wrap of an orbiting scroll which orbits with respect to the fixed scroll in cooperation with the driving motor, and the oil collecting pipe penetrates through the fixed scroll to be communicated with the compression chambers.

The oil collecting pipe may be communicated with the compression chambers at the beginning of the compression of a refrigerant.

The hermetic compressor may also include a decompressing unit disposed at the oil collecting pipe on a path through which oil flows from an outlet of the oil separator into the compression chambers.

The compression chambers in which oil is supplied may be formed as a pair at symmetrical positions to each other with respect to the center of the fixed scroll, and have the same internal pressure, each compression chamber being simultaneously communicated with the oil collecting pipe.

The pair of compression chambers may be communicated with the oil collecting pipe via a pair of oil supply channels formed at the fixed scroll.

The lengths of the oil supply channels for connecting the oil collecting pipe to each compression chamber may be the same.

An end of each oil supply channel communicated with the compression chambers may be located at the center of a circular trace along which a certain point of the end of the orbiting wrap moves in cooperation with the orbiting motion of the orbiting scroll.

The compression chambers in which oil is supplied may be formed as a pair to be symmetrical to each other with respect to the center of the fixed scroll, and each compression chamber is configured to have a different internal pressure, each compression chamber being alternately communicated with the oil collecting pipe.

The end of each oil supply channel communicated with the compression chambers may be located at the center of a circular trace along which a certain point of the end of the orbiting wrap moves in cooperation with the orbiting motion of the orbiting scroll.

A refrigeration cycle as embodied and broadly described herein may include a plurality of hermetic compressors; a plurality of oil separators configured to separate oil from a refrigerant discharged from the plurality of compressors; oil converging pipes configured to collect oil separated by the plurality of oil separators into one portion; oil supply pipes configured to supply oil collected via the oil converging pipes into each compressor; and control valves disposed at the oil supply pipes, respectively, to control whether to supply oil.

Each of the plurality of compressors may include a casing having a hermetic inner space and having suction pipe and discharge pipe connected thereto, a driving motor installed within the inner space of the casing and configured to generate a driving force, and a compressing unit installed within the inner space of the casing and operated by the driving motor to form compression chambers for compressing a refrigerant, wherein the oil supply pipes are communicated with the compression chambers.

The control valves may control such that an oil introduction into the compression chambers of a non-operating compressor and an oil discharge therefrom are prevented.

A decompressing unit may be provided at each oil converging pipe.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing that defines a hermetic interior space;

a suction pipe and a discharge pipe each coupled to the casing;

a driving motor provided in the interior space;

a compressing device provided in the interior space, wherein the compressing device receives a driving force from the driving motor and operates to form compression chambers that compress a refrigerant in response thereto;

an oil separator that separates oil from refrigerant discharged from the compressing device; and an oil collecting pipe that extends between the oil separator and the compressing device, wherein the oil collecting pipe receives oil from the oil separator and directs the received oil to the compression chambers formed in the compressing device, and wherein the oil collecting pipe injects oil into the compression chambers only, after the compression chambers are formed in the compressing device.

2. The compressor of claim 1, further comprising a decompressing device provided with the oil collecting pipe, wherein the decompressing device is provided at a portion of the oil collecting pipe between an outlet of the oil separator and an inlet into the compression chambers.

3. The compressor of claim 1, wherein the compressing device comprises a fixed scroll and an orbiting scroll each provided in the interior space, wherein a fixed wrap of the fixed scroll and an orbiting wrap of the orbiting scroll are inter-engaged so as to form the compression chambers as the orbiting scroll orbits with respect to the fixed scroll in response to the driving force generated by the driving motor.

4. The compressor of claim 3, wherein the oil collecting pipe penetrates through the fixed scroll so as to communicate with the compression chambers.

5. The compressor of claim 4, wherein the oil collecting pipe comprises a pair of oil supply channels that each penetrates the fixed scroll so as to simultaneously provide oil to the compression chambers.

6. The compressor of claim 5, wherein the compression chambers comprise a pair of compression chambers that are formed at symmetrical positions with respect to a center of the fixed scroll, wherein an internal pressure of the pail of compression chambers is substantially the same, and wherein the pair of oil supply channels respectively extend to the pair of compression chambers so as to simultaneously supply oil thereto.

7. The compressor of claim 4, wherein the compression chambers comprise a pair of compression chambers that are formed at symmetrical positions with respect to a center of the fixed scroll, wherein an internal pressure of a first of the pair of compression chambers is different than that of a second of the pair of compression chambers, and wherein an end of the oil collecting pipe alternately communicates with the pair of compression chambers so as to alternately supply oil thereto.

8. A refrigeration cycle, comprising:

a plurality of compressors;

a plurality of oil separators corresponding to the plurality of compressors, wherein the plurality of oil separators separates oil from refrigerant discharged by the plurality of compressors;

a plurality of oil converging pipes that collects oil from the plurality of oil separators;

a plurality of oil supply pipes that respectively supplies oil, collected by the plurality of oil converging pipes, to compression chambers of each of the plurality of compressors; and a plurality of control valves respectively provided with the plurality of oil supply pipes to control a flow of oil therethrough, wherein each of the plurality of compressors comprises:

a casing that defines a hermetic interior space;

a driving motor provided in the interior space; and a compressing device provided in the interior space, wherein the compressing device receives a driving force from the driving motor and operates to form compression chambers of the respective compressor that compress refrigerant in response thereto, and wherein a respective one of the plurality of oil supply pipes injects oil into the compression chambers only, after the compression chambers are formed in the compressing device.

9. The refrigeration cycle of claim 8, wherein the compressing device comprises a fixed scroll and an orbiting scroll each provided in the interior space, wherein a fixed wrap of the fixed scroll and an orbiting wrap of the orbiting scroll are inter-engaged so as to form the compression chambers as the orbiting scroll orbits with respect to the fixed scroll in response to the driving force generated by the driving motor.

10. The refrigeration cycle of claim 9, wherein the compression chambers comprise a pair of compression chambers that are formed at symmetrical positions with respect to a center of the fixed scroll, and wherein each of the pair of compression chambers is simultaneously in communication with one of the plurality of oil supply pipes so as to simultaneously receive oil therefrom.

11. The refrigeration cycle of claim 8, wherein each of the plurality of control valves controls a flow of oil into respective compression chambers based on an operating state of a respective compressor of the plurality of compressors.

12. The refrigeration cycle of claim 11, wherein each of the plurality of control valves controls a flow of oil into respective compression chambers based on an amount of refrigerant supplied to a corresponding compressor of the plurality of compressors.

13. A refrigerating apparatus, comprising:

a compressor;

a condenser coupled to a discharge side of the compressor;

an expander coupled to the condenser; and an evaporator coupled to the expander and to a suction side of the compressor, wherein the compressor comprises:

a casing that defines an interior space;

a suction pipe and a discharge pipe each coupled to the casing;

a compressing device provided in the interior space, wherein the compressing device receives a driving force from a driving motor and operates to form compression chambers in response thereto;

an oil separator that separates oil from refrigerant discharged from the compressing device; and an oil collecting pipe that extends between the oil separator and the compressing device, wherein the oil collecting pipe receives oil from the oil separator and directs the received oil to the compression chambers formed in the compressing device, and wherein the oil collecting pipe injects oil into the compression chambers only, after the compression chambers are formed in the compressing device.

* * * * *